US005449866A

United States Patent [19]

Moss

[11] Patent Number: 5,449,866

[45] Date of Patent: Sep. 12, 1995

[54] ARRANGEMENT FOR DAMPING SOUND IN A PIPE SYSTEM

[75] Inventor: Hans Moss, Veldhoven, Netherlands

[73] Assignee: AB Volvo, Göteborg, Sweden

[21] Appl. No.: 254,671

[22] Filed: Jun. 6, 1994

Related U.S. Application Data

[63] Continuation of Ser. No. 981,478, Nov. 25, 1992, abandoned.

[30] Foreign Application Priority Data

Nov. 26, 1991 [SE] Sweden ..... 9103522

[51] Int. Cl.[6] ..... F01N 7/08

[52] U.S. Cl. ..... 181/228; 181/258; 181/276

[58] Field of Search ..... 181/222, 224, 227, 228, 181/229, 231, 252, 255, 256, 258, 264, 276, 282

[56] References Cited

U.S. PATENT DOCUMENTS

| | | | |
|---|---|---|---|
| 3,117,650 | 1/1964 | Ludlow et al. | 181/228 |
| 3,119,459 | 1/1964 | Ludlow et al. | 181/228 |
| 3,145,338 | 8/1964 | Downs | 324/58 |
| 3,396,812 | 8/1968 | Wilcox et al. | 181/228 |
| 3,429,397 | 2/1969 | Case | 181/227 |
| 3,752,260 | 8/1973 | Heath | 181/228 |
| 4,228,868 | 10/1980 | Raczuk | 181/252 X |
| 4,537,278 | 8/1985 | Okada et al. | 181/227 |
| 4,872,528 | 10/1989 | Goplen et al. | 181/228 |
| 4,936,413 | 6/1990 | Lee | 181/264 |
| 4,993,512 | 2/1991 | Lescher | 181/227 |

OTHER PUBLICATIONS

Abstract: SU 1437-517-A, Kochetov O. S., published Nov. 15, 1988.

*Primary Examiner*—Khanh Dang

*Attorney, Agent, or Firm*—Burns, Doane, Swecker & Mathis

[57] ABSTRACT

The invention relates to a sound-damping arrangement in a passageway system or pipe system for flowing gases, in particular in an exhaust system for internal combustion engines. The arrangement comprising at least one pipe which communicates with at least two chambers or openings, for example in a form of a muffler and/or a passageway/pipe-outlet, in such a manner that multiples of standing waves can arise in the pipe between both the chambers or openings. At least one tube is arranged in the pipe, with one end of the tube serving as in inlet while the other end of the tube is totally or partially closed. The inlet of the tube is arranged in, or in the vicinity of, one of the maximum sound-pressure regions of the pipe so as to dampen at least one maximum sound pressure.

22 Claims, 1 Drawing Sheet

ARRANGEMENT FOR DAMPING SOUND IN A PIPE SYSTEM

This application is a continuation of application Ser. No. 07/981,478, filed Nov. 25, 1992, abandoned.

TECHNICAL FIELD

The present invention relates to an arrangement for damping sound in a pipe system for flowing gases, in particular in an exhaust system for internal combustion engines.

BACKGROUND OF THE INVENTION

A passageway system or pipe system which is connected to a noise source, for example in exhaust system mounted to an internal combustion engine, is generally made up of a plurality of passageways or pipes together with one or more mufflers. From an acoustic point of view these parts make up one or more so called mass-spring systems, where each muffler acts as a spring and in which the air or the gas in the pipe acts as the mass. The spring stiffness is thus directly proportional to the square of the sound velocity for the gas medium which is present and inversely proportional to the volume of the muffler. The mass for respective passageway sections is directly proportional to the length of the passageway divided by its area.

For an exhaust system made up of a muffler and an inlet and outlet passageway a so-called system resonant frequency will arise. At this resonant frequency the so-called input damping is negative, i.e. sound pulses from, for example, exhaust valve openings exit the system as amplified sound.

For internal combustion engines in motor vehicles it is desired that this resonant frequency lies below the ignition frequency of the engine when idling. For a 4-cylinder engine with an idling speed of 750 rpm this means that a first resonant frequency of the system considerably below 25 Hz is sought. This low resonant frequency is possible to achieve with the help of a very large muffler and a moderate passageway length downstream of the muffler. Due to space considerations, vehicle design restricts the possibility of using a large muffler and so in practice it is advantageous to obtain low resonant frequency by placing the muffler well upstream in the system so that the length of the passageway downstream of the muffler can be increased by a sufficient amount.

With increased passageway length downstream of the muffler the risk increases that so-called standing sound waves of half the wave length (or multiples thereof) in frequency coincide with the ignition frequency of the engine or multiples thereof at various engine speeds.

With a pipe length of, for example, 1.4 m downstream of the muffler and normal exhaust temperatures of, with normal driving, around 200° C., strong resonances arise due to the so-called first standing wave (so-called "half lambda") at 160 Hz.

For a 5-cylinder engine the first standing wave coincides with the firing frequency at approximately 4000 rpm, with double ignition frequency at approximately 2000 rpm and trip ignition frequency at around 1300 rpm. This results in greatly increased noise amplification.

With higher exhaust temperatures, i.e. when the engine is under greater load, corresponding resonance amplification occurs at higher engine speeds.

At full load when the exhaust gas temperature in the exhaust system's latter section often exceeds 700° C., the resonance amplification is delayed until almost double engine speed. The second so-called standing wave, i.e. when the full sound wave length coincides with 1.4 m pipe length, gives double resonant frequency 32 Hz. In other words resonance amplification during normal driving arises even at 8000 rpm with the ignition frequency, at 4000 rpm with the double ignition frequency and at 2600 rpm with the triple ignition frequency. These latter resonance amplifications of the ignition frequency and their multiples are generally somewhat milder.

An alternative way of achieving a low first resonant frequency of the system is to add a further muffler. Such a system is shown in, for example, U.S. Pat. No. 4,537,278, FIG. 1. A double mass-spring system does however give rise to a second system resonant frequency. This normally arises at around 70 to 120 Hz. Further disadvantages with this solution are that it is relatively expensive to produce and its weight is increased.

In U.S. Pat. No. 3,316,812 and U.S. Pat. No. 3,415,338 so-called quarter-wave tubes are used to reduce the disadvantages with the one muffler system's standing wave phenomena of the half wave length or its multiples ($\lambda$, $1.5\lambda$, $2\lambda$, etc.) arising in pipe sections located between the free chambers as well as between mufflers or between the muffler and the exhaust outlet.

These alternative solutions have the common disadvantage that the temperature in the quarter-wave tubes normally differs greatly from the temperature in the exhaust system passageway.

This means that the quarter-wave tube's constant length corresponds to one of $\lambda 2$, $1.5\lambda$ etc., in the pipe 16 only within a very restricted exhaust gas temperature range.

Since a so-called quarter-wave tube of traditional form has very narrowband damping characteristics, these alternative solutions present large restrictions in the muffler properties for the ignition pulse frequency and its multiples.

These disadvantages will be apparent from the following examples:

If it is an object to dampen the resonance amplification of any of the engine's pulse frequencies (the basic ignition frequency and its multiples) which are associated with the first standing wave, according to U.S. Pat. No. 3,396,812 the quarter-wave tube should be employed at the maximum pressure region for the standing wave. This means that the connection of the tube should be placed in the central region of the pipe.

If the quarter-wave tube's transverse dimension corresponds to the transverse dimension of the pipe, a very effective sound dampening of the half-wave resonant frequency is obtained in a known manner. This however applies only within a very restricted frequency range. It is furthermore known that amplifications of other frequencies arise due to the so-called sideband effects. With exemplified length and transverse dimensions these amplifications are achieved in a known manner at about 0.7 times the original resonant frequency and at about 1.4 times the original resonant frequency.

If, with 5-cylinder engines, sound damping of second order firing pulse frequency is desired, at the same engine speed a strong amplification of third order ignition pulse frequency is obtained.

Since the quarter-wave tube according to the example is externally located, temperature differences of up to 600° to 700° C. between the tube and the exhaust pipe arise.

If for example an external quarter-wave pipe's length is adapted so as to be effective at an exhaust pipe temperature of 200° C., under full load an incorrect frequency correlation of up to a factor of 1.8 is caused. When idling and under part-load the error in the correlation can be up to a factor of 0.6.

Incorrect correlation can result in both that the necessary damping is not achieved and that sound which lies near to the ignition frequency or its multiples is amplified. This can arise because of the sideband amplifications at frequencies coinciding with the ignition frequency or its multiples.

SUMMARY OF THE INVENTION

It is an object of the invention to provide a damping arrangement for exhaust passageways which, in an effective, cheap and lightweight manner, provides sufficient damping of chosen frequency ranges.

This object is achieved in accordance with the present invention by means of an arrangement for damping sound in a pipe system for flowing gases, in particular in an exhaust system for internal combustion engines, said arrangement comprising i) at least one pipe of predetermined cross-sectional area having a first end and a second end, within which pipe multiples of standing waves having maximum sound-pressure regions can arise, and ii) at least one main tube of predetermined cross-sectional area arranged in said pipe, said main tube having a first end and a second end, said first end serving as an inlet to an inlet region of said main tube and said second end being at least partially closed;

wherein said inlet of the main tube is arranged in proximity to one of said maximum sound-pressure regions of the pipe so as to dampen at least one maximum sound-pressure, and said pipe presents a through-flow area substantially equal to the predetermined cross-sectional area of the pipe minus the predetermined cross-sectional area of the main tube.

It is also desirable to obtain broadband damping characteristics with reduced sideband amplification. This is achieved by arranging a resistive filter with a predetermined flow resistance within the inlet region of the main tube.

Broadband damping characteristics with greatly reduced sideband amplification are also achieved according to the invention by means of the end region of the main tube/tubes being provided with a resistive filter with greatly restricted gas permeability, preferably less than 1% of the tailpipe's through-flow area A1 minus A2.

Further scope of applicability of the present invention will become apparent from the detailed description given hereinafter. However, it should be understood that the detailed description, while indicating preferred embodiments of the invention, is given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF A PREFERRED EMBODIMENT

Figure 1:
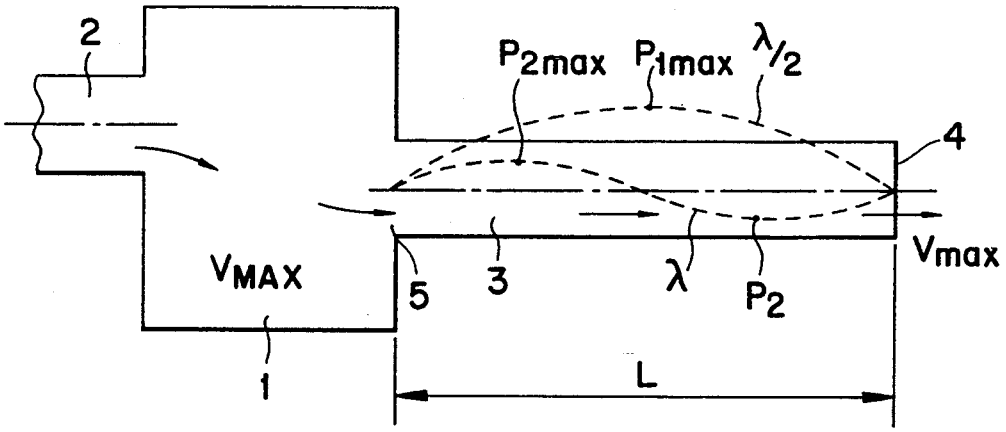
Fig. 1 (PRIOR ART)
FIG. 1 shows a schematic plan view of the end section of a typical exhaust system.

An exhaust system is shown in FIG. 1 which is connected to a not shown source of exhaust gases. The exhaust system comprises a muffler 1, a pipe or passageway 2 supplying gases to the muffler 1, and a tailpipe 3 provided with an outlet 4. The tailpipe 3 has a length denoted by L. Exhaust gases are caused to flow through the system in a manner indicated by arrows. A first standing wave of the tailpipe is denoted by $\lambda/2$ whilst a second standing wave is denoted by $\lambda$. Each wave generates a maximum sound pressure which is denoted by P1 max and P2 max respectively. The maximum particle velocity of the wave, Vmax, for both waves arises at the pipe outlet.

Figure 2:
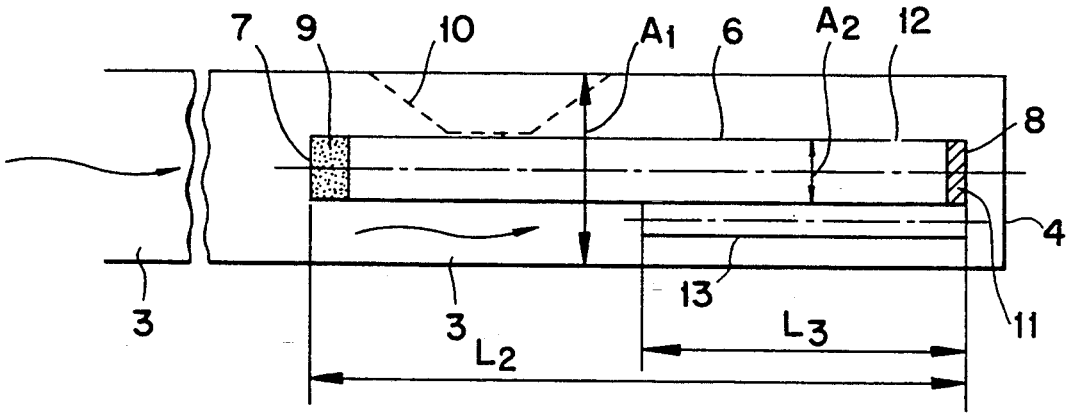
FIG. 2 shows a longitudinal section of the end section of the tailpipe according to the invention.

In FIG. 2, one embodiment according to the invention consists of a resonance tube or main tube 6 which is located within the tailpipe 3. The resonance tube 6 presents a length L2 which is at least 0.75, preferably at least 0.9, times of the length L of the tailpipe 3. The tube 6 is provided with an inlet 7 which is located substantially within the acoustic maximum pressure region P1 max. The tube 6 further presents a remote end 8, which end forms a reflection element for the standing wave created in the tube 6. The standing wave has the form of a quarter wave length with maximum pressure at the remote end 8 and maximum particle velocity at its inlet opening 7. In FIG. 2, A1 denotes the cross-sectional area of the exhaust pipe whilst A2 denotes the cross-sectional area for the tube.

An arrangement according to the embodiment shown in FIG. 2 and with an area ratio of A2/A1 approximately equal to 0.3 provides more than 30 dB damping of the first standing wave within the tailpipe 3 (FIG. 1). In practical tests the damping has been shown to exceed 30 dB independently of the temperature level within the tailpipe 3. This temperature independence is to be expected since no discernible temperature difference between the tube 6 and gasflow within the tailpipe arises.

The above described embodiment provides customary sideband amplification, which is why a lower A2/A1 ratio in many applications may be preferred.

In another embodiment of the invention an increase in the ratio A2/A1 can however by advantageous for the inclusion of an acoustic resistive filter 9 in the inlet 7 of the tube 6. The placing of the filer 9 is selected with regard to the fact that the standing wave in the tube 6 has its maximum particle velocity at the inlet 7.

Tests have been performed with a filter characteristic of approximately 100 $Ns/m^3$ and with a ratio A2/A1=0.30. The tests show that sideband amplification is virtually eliminated, and a damping of more than 15 dB at previous resonances of P1 max is achieved which is satisfactory.

From tests performed with the filter 9, it has been shown that the length L2 can be reduced by up to 20%.

This reduction in length is achieved by changing the impedance of the filter 9 and can be of very great importance. This is an important advantage since it is very difficult to find room for a sufficiently long straight tailpipe 3 on a vehicle.

Furthermore, if the ratio A2/A1 tends towards 1 the main tube 6 can be connected in a simple manner to the tailpipe 3 by the provision of pressed-in stanchions 10 in the sleeve of the tailpipe 3 and, for example, by welding the tube to said stanchions.

The resistive losses in the filter 9, the so-called flow-resistance, are accurately adapted through choice of the A2/A1-ratio, desired length reduction, dampening of P1 max and allowed values of sideband amplification. The flow resistance should however lie within the interval 5–1800 $Ns/m^3$, though preferably within the interval 30–300 $Ns/m^3$. The filter should be placed at a distance of 0.6, though preferably 0.9, times the length L2 from the remote end 8 of the main tube 6. The main tube 6 does not necessarily have to be positioned within the central region of the tailpipe 3.

A further embodiment of the invention, which can also be combined with the above embodiments, makes use of the fact that in principle the A2/A1-ratio can be increased at the same time that, with regard to the sideband amplification, a controlled acoustic leakage is provided in the main tube 6 at the region of its remote end 8. This can be achieved by the provision of a leakage filter 11. The leakage filter can suitably form the remote end 8.

As with the filter 9, the leakage filter 11 must be adapted to the A2/A1 ratio in the system with regard to the area of the leakage filter, the desired length reduction, the damping requirement for P1 max together with the acceptance of sideband amplification in the system. Independent of its cross-sectional area, the leakage filter 11 is suitably given a very limited permeability, or more precisely, less than 1% of A1 minus A2, i.e. less than 0.01 times the through-flow area of the tailpipe 3.

In its simplest form the leakage filter 11 can be in the form of one or more very small holes 12 in the end 8 or in the sleeve of the main tube 6. The combined area A3 of these holes 12 is dimensioned on the basis of the fact that A3 is, at maximum, 0.01 times A1 minus A2. The diameter of the holes 12 preferably lies within the range 3–5 mm.

As an object to also obtain sound dampening for higher orders of standing waves within the system, for example for the second standing wave=λ (FIG. 1), the main tube 6 can be complemented by an auxiliary tube 13. The auxiliary tube 13 has a length L3 at lest 0.75, preferably at least 0.9, times one quarter of the length L of the pipe 3. The auxiliary tube is preferably arranged on and parallel to the main tube and extends from the second end 8 of the main tube towards the first end 7 thereof. Otherwise this embodiment can either totally or partially correspond to the tube 6. The auxiliary tube 13 can of course form an embodiment of the invention on its own.

The filter 9 and/or the leakage filter 11 can be made from traditional heat-resistant glassfibre or sinter or steel wool linings. If normal fibreglass discs are used (with specific flow-resistance of approximately 50 KNs/m4 per 50 mm thickness) in the thickness of the filter 9 can be limited to 2–3 mm.

The invention is not restricted to the above described embodiments, but can of course be varied within the scope of the claims. For example, the main tube 6 may be located in a pipe between two mufflers, or in a pipe connecting a muffler to the atmosphere. Indeed, the main tube may be located in a pipe which is open to the atmosphere at both its ends.

What is claimed is:

1. An apparatus for damping sound in a pipe system for flowing gases, in particular in an exhaust system for internal combustion engines, comprising:

at least one pipe of predetermined cross-sectional area having a first end and a second end, within which pipe multiples of standing waves having maximum sound-pressure regions arise;

at least one resonance tube of predetermined cross-sectional area in said pipe, said main resonance tube having an open first end coextensive with the cross sectional area and a second end, said first end serving as an inlet to an inlet region of said main tube and said second end being at last partially closed;

means for supporting the main resonance tube a predetermined distance from the pipe so that the main resonance tube does not contact the pipe; and, an acoustically pervious filter positioned in the inlet region;

wherein said inlet of the main resonance tube is arranged in proximity to one of said maximum sound-pressure regions of the pipe so as to generate a standing wave in the resonance tube having a maximum particle velocity at the inlet and a maximum pressure at the second end to dampen at least one maximum sound-pressure, and said pipe presents a through-flow area substantially equal to the predetermined cross-sectional area of the pipe minus the predetermined cross-sectional area of the main resonance tube.

2. An apparatus as claimed in claim 1, wherein said predetermined cross-sectional area of the main tube is greater than 5% of the predetermined cross-sectional area of the pipe.

3. An apparatus as claimed in claim 1, wherein said predetermined cross-sectional area of the main tube is greater than 20% of the predetermined cross-sectional area of the pipe.

4. An apparatus as claimed in claim 1, wherein said filter provides a flow resistance within the range 5–2000 $Ns/m^3$.

5. An apparatus as claimed in claim 1, wherein the filter provides a flow resistance within the range 30–300 $Ns/m^3$.

6. An apparatus as claimed in claim 1, wherein the second end of the main tube is provided with means to restrict sound permeability.

7. An apparatus as claimed in claim 6, wherein said means is a leakage filter arranged to provide a total degree of permeability less than 1% of the through-flow area of the pipe.

8. An apparatus as claimed in claim 1, wherein the length of the main tube is at least 0.75 times one half of the length of the pipe.

9. Apparatus as claimed in claim 8, wherein the filter is arranged at a distance of at least 0.6 times the length of the main tube measured from the second end of the main tube.

10. An apparatus as claimed in claim 8, wherein the main tube is mounted substantially at a central region of the pipe.

11. An apparatus as claimed in claim 1, wherein the main tube is fixedly supported on dee-drawn stanchions mounted inside the pipe.

12. An apparatus as claimed in claim 1, wherein the length of the main tube is at least 0.75 times one half of the length of the pipe.

13. The apparatus as claimed in claim 1, wherein the predetermined cross-sectional area of the main tube is less than 40% of the predetermined cross-sectional area of the pipe.

14. The apparatus as claimed in claim 1, wherein the predetermined cross-sectional area of the main tube is about 30% of the predetermined cross-sectional area of the pipe.

15. An apparatus for damping sound in a pipe system for flowing gases, in particular in an exhaust system for internal combustion engines, comprising:

at least one pipe of predetermined cross-sectional area having a first end and a second end, within which pipe multiples of standing waves having maximum sound-pressure regions arise;

at least one main resonance tube of predetermined cross-sectional area at least 0.75 times half of said length of said pipe, said main resonance tube having an open first end coextensive with the cross-sectional area and a second end, said first end serving as an inlet to an inlet region of said main tube and said second end being at least partially closed;

an auxiliary tube having a length at least 0.75 times one quarter of the length of the pipe parallel to the main resonance tube and extending from the second end of the main resonance tube toward the first end of the main resonance tube;

means for supporting said main resonance tube; and means for supporting said auxiliary tube, wherein said main resonance tube and said auxiliary tube are disposed within said pipe a predetermined distance from the pipe with said inlet of said main resonance tube being positioned in proximity to one of said maximum sound-pressure regions of the pipe so as to generate a standing wave in the resonance tube having a maximum particle velocity at the inlet and a maximum pressure at the second end to dampen at least one maximum sound-pressure;

wherein said pipe presents a through-flow area substantially equal to the predetermined cross-sectional area of the pipe minus the predetermined cross-sectional area of the main resonance tube.

16. An apparatus as claimed in claim 15, wherein an acoustically previous filter is arranged within said inlet region of said main tube.

17. An apparatus as claimed in claim 16, wherein said filter provides a flow resistance within the range 5–2000 $Ns/m^3$.

18. An arrangement as claimed in claim 15, wherein the second end of the main tube is provided with means to restrict sound permeability.

19. An apparatus as claimed in claim 18, wherein said means is a leakage filter arranged to provide a total degree of permeability less than 1% of the through-flow area of the pipe.

20. An apparatus as claimed in claim 15, wherein the main tube is fixedly supported on deep-drawn stanchions mounted inside the pipe.

21. An apparatus for damping sound in a pipe system for flowing gases, in particular in an exhaust system for internal combustion engines, comprising:

at least one pipe of predetermined cross-sectional area having a first end and a second end, within which pipe multiples of standing waves having maximum sound-pressure regions arise;

at least one main tube of predetermined cross-sectional area arranged in said pipe, said main tube having a first end and a second end, said first end serving as an inlet to an inlet region of said main tube and said second end being at least partially closed; and, an acoustically pervious filter having a flow resistance within the range of 5–2000 $Ns/m^3$ arranged in the inlet region of said main tube;

wherein said inlet of the main tube is arranged in proximity to one of said maximum sound-pressure regions of the pipe so as to dampen at least one maximum sound-pressure, and said pipe presents a through-flow area substantially equal to the predetermined cross-sectional area of the pipe minus the predetermined cross-sectional area of the main tube.

22. An apparatus for damping sound in a pipe system for flowing gases, in particular in an exhaust system for internal combustion engines, comprising:

at least one pipe of predetermined cross-sectional area having a first end and a second end, within which pipe multiples of standing waves having maximum sound-pressure regions arise;

at least one main tube of predetermined cross-sectional area at least 0.75 times half of said length of said pipe, said main tube having a first end and a second end, said first end serving as an inlet to an inlet region of said main tube and said second end being at least partially closed;

an acoustically pervious filter having a flow resistance within the range of 5–2000 $Ns/m^3$ arranged in the inlet region of said main tube; and, an auxiliary tube having a length at least 0.75 times one quarter of the length of the pipe arranged parallel to the main tube and extending from the second end of the main tube towards the first end of the main tube;

wherein main tube and said auxiliary tube are arranged within said pipe, with said inlet of said main tube being arranged in proximity to one of said maximum sound-pressure regions of the pipe so as to dampen at least one maximum sound-pressure, and wherein said pipe presents a through-flow area substantially equal to the predetermined cross-sectional area of the pipe minus the predetermined cross-sectional area of the main tube.

* * * * *